US009830780B2

(12) United States Patent
Cuddy et al.

(10) Patent No.: US 9,830,780 B2
(45) Date of Patent: Nov. 28, 2017

(54) SYSTEM AND METHOD FOR PROVIDING A GAME WITH DYNAMIC SYMBOL STACKING

(71) Applicant: Video Gaming Technologies, Inc., Franklin, TN (US)

(72) Inventors: Ryan Cuddy, Franklin, TN (US); Lyndsay Nelson, Franklin, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 680 days.

(21) Appl. No.: 14/030,895

(22) Filed: Sep. 18, 2013

(65) Prior Publication Data

US 2014/0094270 A1 Apr. 3, 2014

Related U.S. Application Data

(63) Continuation-in-part of application No. 13/631,950, filed on Sep. 29, 2012, now Pat. No. 9,183,707.

(51) Int. Cl.

| | |
|---|---|
| ***G07F 17/00*** | (2006.01) |
| ***G07F 19/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/326* (2013.01); *G07F 17/3213* (2013.01); *G07F 17/3262* (2013.01)

(58) Field of Classification Search

CPC .... G07F 17/32; G07F 17/3213; G07F 17/326; G07F 17/3262; G07F 17/3265; G07F 17/3267; G07F 17/34

See application file for complete search history.

(56) References Cited

U.S. PATENT DOCUMENTS

| | | | | |
|---|---|---|---|---|
| 5,085,436 | A * | 2/1992 | Bennett | G07F 17/3244 273/143 R |
| 5,102,137 | A * | 4/1992 | Ekiert | G07F 17/3244 273/143 R |
| 6,394,902 | B1 | 5/2002 | Glavich et al. | |
| 6,413,162 | B1 | 7/2002 | Baerlocher et al. | |
| 6,485,367 | B1 | 11/2002 | Joshi | |
| 6,641,477 | B1 | 11/2003 | Dietz, II | |
| 6,695,696 | B1 | 2/2004 | Kaminkow | |
| 6,796,903 | B1 * | 9/2004 | Bryant | G07F 17/3244 273/139 |
| 6,921,335 | B2 | 7/2005 | Rodgers et al. | |

(Continued)

OTHER PUBLICATIONS

PCT Search Report and Written Opinion for related matter PCT/US2014/056213 dated Dec. 31, 2014; 12 pp.

*Primary Examiner* — Milap Shah

(74) *Attorney, Agent, or Firm* — Armstrong Teasdale LLP

(57) ABSTRACT

A method for playing a game of chance on a gaming machine that includes a display and a plurality of reel positions associated with the game of chance. The plurality of reel positions are configured to be populated with predefined reel strips selected from a reel strip database. The method includes providing the game of chance on the gaming machine, selecting a plurality of predefined reel strips from the reel strip database, populating the plurality of reel positions with the selected plurality of predefined reel strips, and displaying a result of spinning the selected plurality of predefined reel strips.

16 Claims, 8 Drawing Sheets

(56) References Cited

U.S. PATENT DOCUMENTS 7,074,127 B2 7/2006 Cuddy et al.
7,252,589 B1 8/2007 Marks et al.
7,553,231 B2 6/2009 Rodgers et al.
7,591,724 B2 9/2009 Baerlocher
7,914,376 B2 3/2011 Walker et al.
8,574,060 B2 11/2013 Nakamura et al.
8,727,872 B2 5/2014 Hoffman et al.
9,183,707 B2 * 11/2015 Cuddy ..... G07F 17/3267
2003/0224849 A1 12/2003 Geiger
2004/0072612 A1 4/2004 Rodgers et al.
2004/0137982 A1 7/2004 Cuddy et al.
2005/0009597 A1 * 1/2005 Daly ..... G07F 17/34 463/20
2005/0070354 A1 3/2005 Baerlocher et al.
2005/0239539 A1 * 10/2005 Inamura ..... G07F 17/3265 463/20
2006/0116193 A1 * 6/2006 Sato ..... G07F 17/3265 463/20
2006/0160595 A1 7/2006 Gerson et al.
2006/0183534 A1 8/2006 Yoshimi
2006/0264254 A1 11/2006 Aoki
2006/0281525 A1 12/2006 Borissov
2007/0105611 A1 * 5/2007 O'Halloran ..... G07F 17/3244 463/16
2008/0234033 A1 9/2008 Berman et al.
2008/0318660 A1 12/2008 Nores
2009/0298573 A1 * 12/2009 Bramble ..... G07F 17/32 463/20
2012/0064961 A1 3/2012 Vancura
2012/0172106 A1 * 7/2012 Caputo ..... G07F 17/34 463/20
2012/0295688 A1 11/2012 Watkins et al.
2013/0252699 A1 * 9/2013 Nauman ..... G07F 17/34 463/20
2014/0179402 A1 * 6/2014 Delekta ..... G07F 17/34 463/20
2015/0080100 A1 * 3/2015 Lee ..... G07F 17/326 463/20
2015/0287269 A1 * 10/2015 Berman ..... G07F 17/34 463/20
2016/0110947 A1 * 4/2016 Eisenmann ..... G07F 17/3265 463/21

* cited by examiner

FIG. 5

118

| 402 | 404 | 406 | 408 | 410 |
|---|---|---|---|---|
| A | D | WILD | C | E |
| WILD | E | WILD | D | C |
| C | F | WILD | A | D |

SYSTEM AND METHOD FOR PROVIDING A GAME WITH DYNAMIC SYMBOL STACKING

CROSS REFERENCE TO RELATED APPLICATIONS

This application is a continuation-in-part application of U.S. patent application Ser. No. 13/631,950, filed Sep. 29, 2012, entitled "SYSTEM AND METHOD FOR PROVIDING A GAME WITH DYNAMIC SYMBOL STACKING", the disclosure of which is hereby incorporated herein by reference in its entirety

BACKGROUND

The embodiments described herein relate generally to gaming systems and methods that provide games of chance and, more particularly, to systems and methods for providing a game of chance with dynamic symbol stacking.

Conventionally, gaming machines provide games wherein a player has one or more opportunities to obtain a winning symbol combination on mechanical or video reels. The winning symbol combination may be along the same payline or on different paylines (known as a scatter pay). By providing gaming devices with more winning symbol combinations, players have more opportunities to receive an award. However, the probability of obtaining the largest award (i.e., the jackpot award) is typically much lower than the probability of obtaining the other awards in a game. Thus, although a player may obtain more awards in a game, these awards are generally relatively small awards and not relatively large awards such as the jackpot award.

Gaming machines that increase the probability of obtaining the relatively large award and specifically, the jackpot award, are desirable. To increase player enjoyment and excitement, it is desirable to provide new games and gaming devices which increase the likelihood or probability that the player will obtain one or more relatively large awards in a game.

BRIEF DESCRIPTION

In one aspect, a gaming machine is provided. The gaming machine includes a game of chance operable upon a wager by a player, and a plurality of reel positions associated with the game of chance, the plurality of reel positions configured to be populated with predefined reel strips selected from a reel strip database. The gaming machine further includes a display that includes a predefined plurality of positions to present a symbol thereon for each of the plurality of selected reel strips, and a processor. The processor is programmed to provide the game of chance on the gaming machine, select a plurality of predefined reel strips from the reel strip database, wherein the selected plurality of predefined reel strips includes a first predefined reel strip comprising a first set of predefined symbols, and a second predefined reel strip, the second predefined reel strip being selected based on the first set of predefined symbols in the first predefined reel strip. The processor is further programmed to populate the plurality of reel positions with the selected plurality of predefined reel strips, and display a result of spinning the selected plurality of predefined reel strips.

In another aspect, a method for playing a game of chance on a gaming machine that includes a display and a plurality of reel positions associated with the game of chance, wherein the plurality of reel positions are configured to be populated with predefined reel strips selected from a reel strip database is provided. The method includes providing the game of chance on the gaming machine, selecting a plurality of predefined reel strips from the reel strip database, populating the plurality of reel positions with the selected plurality of predefined reel strips, and displaying a result of spinning the selected plurality of predefined reel strips.

In yet another aspect, a gaming system including a reel strip database that includes a plurality of predefined reel strips, and a gaming machine is provided. The gaming machine includes a game of chance operable upon a wager by a player, a plurality of reel positions associated with the game of chance, the plurality of reel positions configured to be populated with predefined reel strips selected from the reel strip database, a display comprising a predefined plurality of positions to present a symbol thereon for each of the plurality of selected reel strips, and a processor. The processor is programmed to provide the game of chance on the gaming machine, and select a plurality of predefined reel strips from the reel strip database, wherein the selected plurality of predefined reel strips includes a first predefined reel strip comprising a first set of predefined symbols, and a second predefined reel strip, the second predefined reel strip being selected based on the first set of predefined symbols in the first predefined reel strip. The processor is further programmed to populate the plurality of reel positions with the selected plurality of predefined reel strips, and display a result of spinning the selected plurality of predefined reel strips.

BRIEF DESCRIPTION OF THE DRAWINGS

The embodiments described herein may be better understood by referring to the following description in conjunction with the accompanying drawings.

FIGS. 4 and 5 are screen views of an exemplary video slot game that may be used with the gaming machine shown in FIG. 1;

DETAILED DESCRIPTION

The embodiments described herein relate generally to gaming systems and methods that provide games of chance to a player operating a gaming machine and, more particularly, to systems and methods for providing a game of chance with dynamic symbol stacking.

Exemplary technical effects of the systems, methods, and apparatus described herein include at least one of: (a) providing the game of chance on a gaming machine; (b)

selecting a plurality of predefined reel strips from the reel strip database; (c) populating the plurality of reel positions with the selected plurality of predefined reel strips; and (d) displaying a result of spinning the selected plurality of predefined reel strips.

Figure 1:
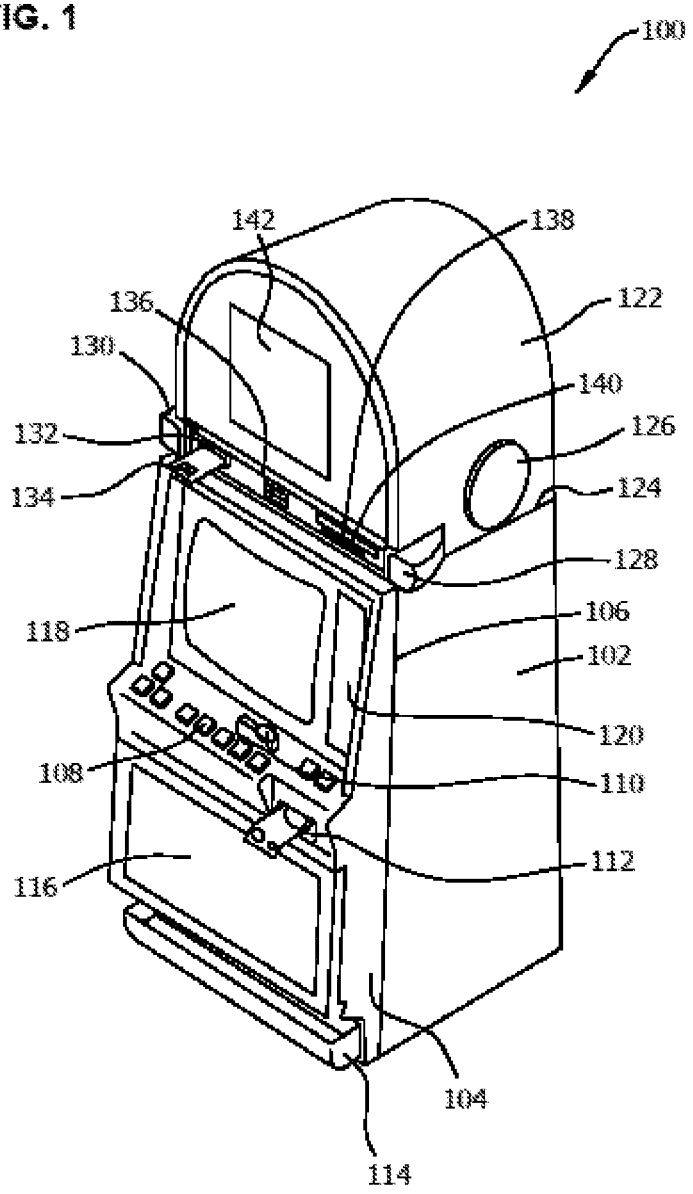
FIG. 1 is a schematic diagram of an exemplary gaming machine.

FIG. 1 is a schematic diagram of an exemplary gaming machine 100 that enables play of a base game and one or more bonus features, if applicable. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a main cabinet 102 having a main door 104 coupled to a front 106 of gaming machine 100. When opened, door 104 provides access to an interior (not shown) of gaming machine 100. In the exemplary embodiment, a plurality of player-input switches and/or buttons 108 is coupled to main door 104. Moreover, in the exemplary embodiment, a coin acceptor 110, for accepting coins and/or tokens, a bill acceptor 112, for accepting and/or validating cash bills, coupons and/or ticket vouchers, a coin tray 114, for collecting a coin-based payout, and a belly glass 116 are each coupled to main door 104. A primary display device 118 and an information panel 120 are viewable through main door 104. In one embodiment, primary display device 118 displays a plurality of reels, such as three to five reels in mechanical or video form. If the reels are in video form, primary display device 118 may be a video monitor. In one embodiment, each reel of the plurality of reels displays a plurality of indicia such as bells, hearts, fruits, numbers, letters, bars or other images which preferably correspond to a theme associated with gaming machine 100.

Primary display device 118 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, primary display device 118 may include touch screen capabilities. In the exemplary embodiment, information panel 120 is a back-lit, silk screened glass panel that includes lettering to indicate general game information including, for example, a number of coins wagered. Coin acceptor 110, bill acceptor 112, player-input buttons 108, primary display device 118, and information panel 120 are each used by a player to play a game on gaming machine 100. Each component 108, 110, 112, 118, and/or 120 is controlled by a gaming machine controller (not shown in FIG. 1) that is housed inside main cabinet 102. Numerous games including, but not limited to only including, video slot games, video poker, video pachinko, video black jack, video card games, and/or video keno may be implemented for play on gaming machine 100.

In the exemplary embodiment, gaming machine 100 also includes a top box 122 that is positioned on a top surface 124 of main cabinet 102. In the exemplary embodiment, top box 122 includes a number of devices that may be used to add features to a game being played on gaming machine 100. Such devices may include, but are not limited to only including, speakers 126, 128, and 130, a ticket printer 132 for printing bar-coded tickets 134, a key pad 136 for entering player tracking information, or player preferences or characteristics, a display 138 for displaying player tracking information and/or player preferences or characteristics, and a card reader 140 for receiving a card containing player tracking information and/or player preferences or characteristics encoded thereon. Card reader 140 may also be used to accept credit cards, printed cards, smart cards, and/or other magnetic stripe cards. Moreover, top box 122 includes a secondary display device 142 that displays, for example, player information, an attract sequence, a bonus game, or any other suitable images. Secondary display device 142 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, secondary display device 142 may include touch screen capabilities. Top box 122 may house additional devices not shown in FIG. 1, such as, for example, a bonus wheel and/or a back-lit silk screened panel that may be used to add bonus features to a game being played on gaming machine 100. During play of a base game, such devices may be controlled by circuitry, such as the gaming machine controller housed within main cabinet 102. During play of a bonus game, such devices may be controlled by circuitry, such as a bonus controller (not shown in FIG. 1) as described in detail below.

Figure 2:
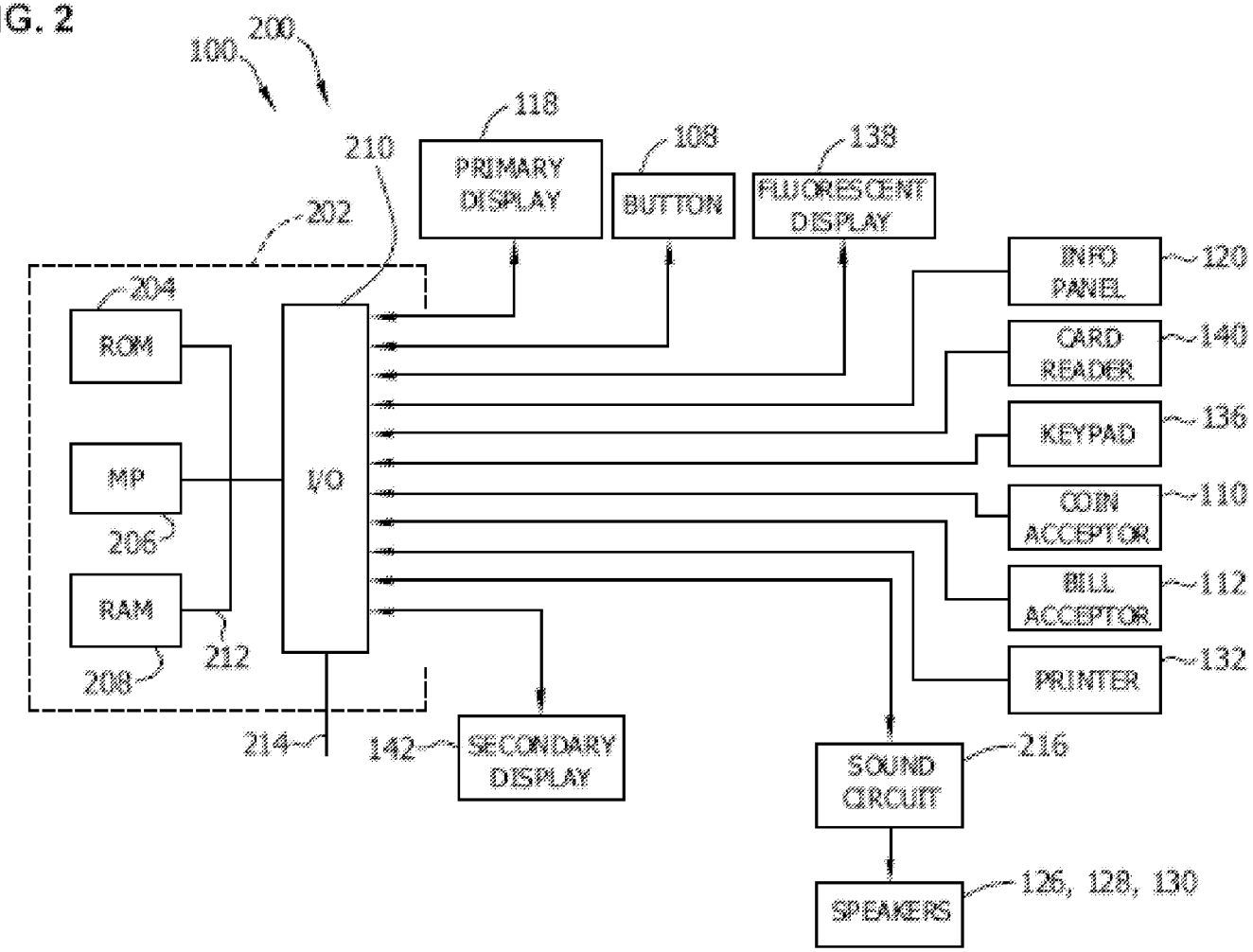
FIG. 2 is a block circuit diagram of an exemplary electrical architecture that may be used with the gaming machine shown in FIG. 1.

FIG. 2 is a block circuit diagram of an exemplary electrical architecture 200 incorporated into an exemplary gaming machine, such as gaming machine 100. In the exemplary embodiment, gaming machine 100 includes a gaming machine controller 202 that includes a read-only memory (ROM) 204, a microcontroller or microprocessor (MP) 206, a random-access memory (RAM) 208, and an input/output (I/O) circuit 210, each coupled via an address/data bus 212. As used herein, the terms "controller" and "processor" may include any programmable system including systems using microcontrollers, reduced instruction set circuits (RISC), application specific integrated circuits (ASICs), logic circuits, and any other circuit or processor capable of executing the functions described herein. The above examples are exemplary only, and are thus not intended to limit in any way the definition and/or meaning of the terms "controller" or "processor". Alternative embodiments of controller 202 may include more than one microprocessor 206, multiple RAM modules 208, and/or multiple ROM modules 204. Moreover, although I/O circuit 210 is shown in FIG. 2 as a single component, one of ordinary skill in the art will appreciate that I/O circuit 210 may include any number or a plurality of different types of I/O circuits. Further, RAM 208 and/or ROM 204 may be implemented as, for example, semiconductor memories, magnetically readable memories, and/or optically readable memories. In one embodiment, each operational component of gaming machine 100 is coupled to I/O circuit 210 via a respective conductor and/or via bus 212. Alternative embodiments may include a single coupling between the operational components of gaming machine 100 and I/O circuit 210. In the exemplary embodiment, I/O circuit 210 is coupled to a gaming network (not shown) via a network interface 214. Moreover, in the exemplary embodiment, architecture 200 includes a sound circuit 216 that generates audio signals and that communicates the audio signals between I/O circuit 210 and speakers 126, 128, and/or 130.

Figure 3:
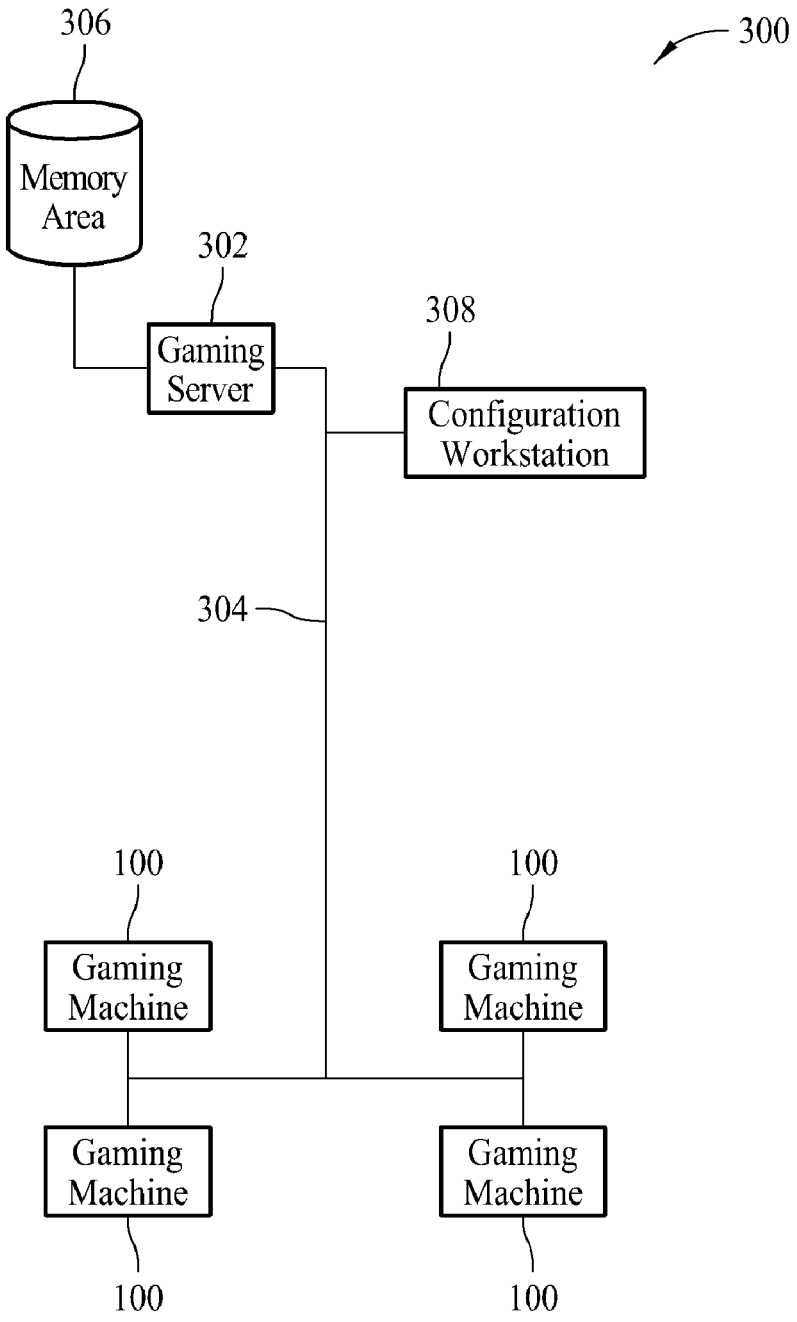
FIG. 3 is a block schematic diagram of an exemplary gaming system that includes a plurality of gaming machines shown in FIG. 1.

FIG. 3 is a block schematic diagram of an exemplary gaming system 300 that includes a plurality of gaming machines 100. Each gaming machine 100 is coupled to one or more servers, such as a gaming server 302, using a network 304. Gaming server 302 includes a processor (not shown) that facilitates data communication between each gaming machine 100 and other components of gaming system 300. Such data is stored in, for example, a memory area 306, such as a database, that is coupled to gaming server 302.

In one embodiment, one or more gaming machines 100 may be remote gaming machines that access a casino over network 304. As such, a player is able to participate in a game of chance on a remote gaming machine. In this embodiment, it will be understood that a player operating a remote gaming machine has virtual access to any casino coupled to network 304 and associated with gaming server 302. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance, remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 302. In such an embodiment, gaming machines 100 display results of a game via primary display device 118 and secondary display device 142 (shown in FIGS. 1 and 2).

In one embodiment, gaming server 302 performs a plurality of functions including, for example, game outcome generation, executing a game play event for a player, player tracking functions, and/or accounting functions, to name a few. However, in alternative embodiments, gaming system 300 may include a plurality of servers that separately perform these functions and/or any suitable function for use in a network-based gaming system.

For example, gaming server 302 may provide a game of chance (e.g., a video slot game) to a player operating one of gaming machines 100. That is, server 302 may display a plurality of reels to a player on primary display device 118. To initiate the video slot game, the player must insert an appropriate amount of money or tokens at coin acceptor 110 or bill acceptor 112 and then push a play button (for example, one of player input buttons 108. When the wager is received, server 302 enables the reels shown on primary display device 118 to spin. Eventually, the reels will come to a stop and depending upon where the reels stop, server 302 determines whether the player wins an award and/or additional credits.

As mentioned above, embodiments of the present disclosure enable players an opportunity to win rewards/credits by dynamically stacking designated symbols (described in further detail below) during a primary game or in a bonus round. Server 302 may initiate this stacking feature when the player has achieved a qualifying condition in the game. In one embodiment, this qualifying condition is a particular arrangement of designated symbols on primary display device 118, as shown in FIG. 4.

Figure 4:
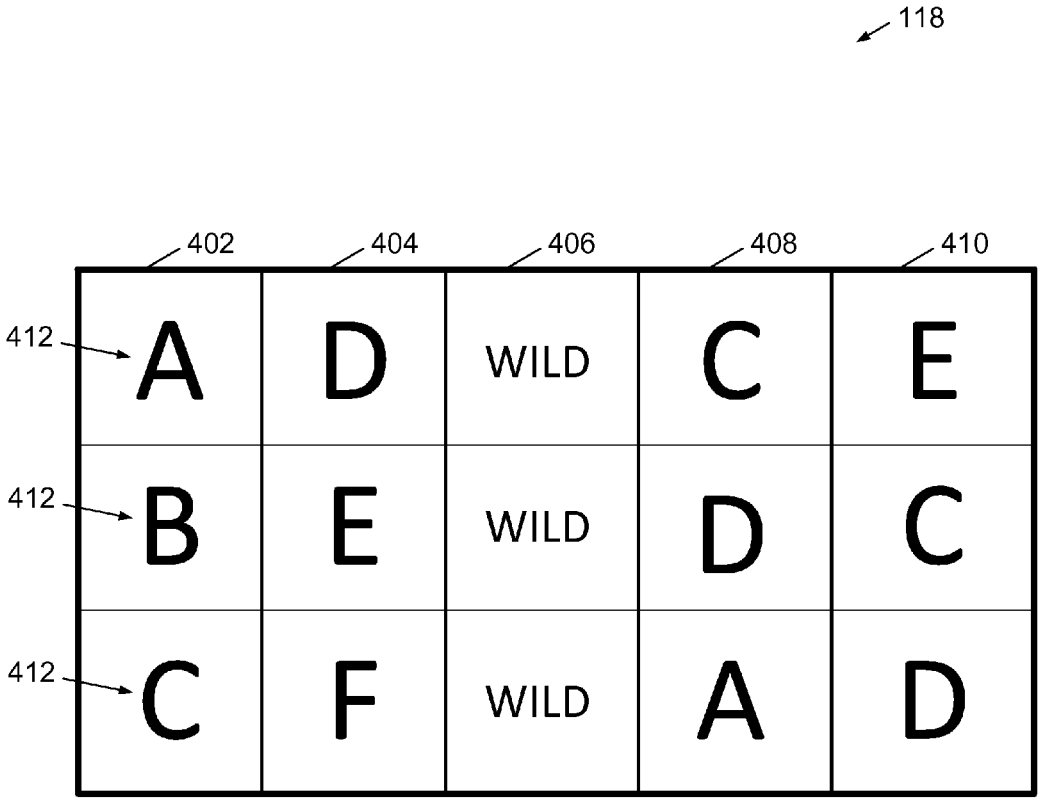

For example, in FIG. 4, a screen view of an exemplary game of chance provided on primary display 118 is shown. Five reals (not shown) represented by columns 402, 404, 406, 408, and 410, respectively, have generated and displayed three symbols 412 each. In this example, a qualifying condition is when each symbol generated and presented in a column is a designated symbol. For example, in FIG. 4, the "wild" symbol is the designated symbol and a third reel (represented by column 406) has generated and presented three "wild" symbols. Thus, as three "wild" symbols have been generated and presented in column 406, server 302 determines that the qualifying condition has been met.

As a result of determining that the qualifying condition has been met, server 302 fixes, locks, or holds stationary the third reel and enables a player to execute a first free "spin" (e.g., a spin/generation of symbols without an additional wager) of a first reel (represented by column 402), a second reel (represented by column 404), a fourth reel (represented by column 406), and a fifth reel (represented by column 410). That is, server 302 enables four of the five reels to remain active while one (e.g., the third reel) is locked in place. After the first free spin, server 302 determines if any of the four active reels generate and present the "wild" symbol. If none of the four active reels generate and present a "wild" symbol, the game may be terminated and an additional wager is needed to initiate a new game. If, however, a "wild" symbol is generated and presented on one of the four active reels, the position displaying the "wild" symbol on the reel is locked and server 302 enables the player to execute a second free spin on the four active reels again. In one embodiment, if a "wild" symbol is generated and presented on one of the four active reels, the entire reel that generated the "wild" symbol is locked and server 302 enables the player to execute a second free spin of the remaining reels. For example, with reference to FIG. 5, the third reel (represented by column 406) is locked and either the entire first reel (represented by column 402) is locked or only the positions displaying the "wild" is locked enabling the remaining positions on the first reel and the second reel (represented by column 404), the fourth reel (represented by column 408), and the fifth reel (represented by column 410) to be spun for a third time. Server 302 may enable this process to continue until either server 302 determines that, for example, each reel has generated a wild symbol or when server 302 determines that an additional spin does not result in a generation of a "wild" symbol.

Figure 6:
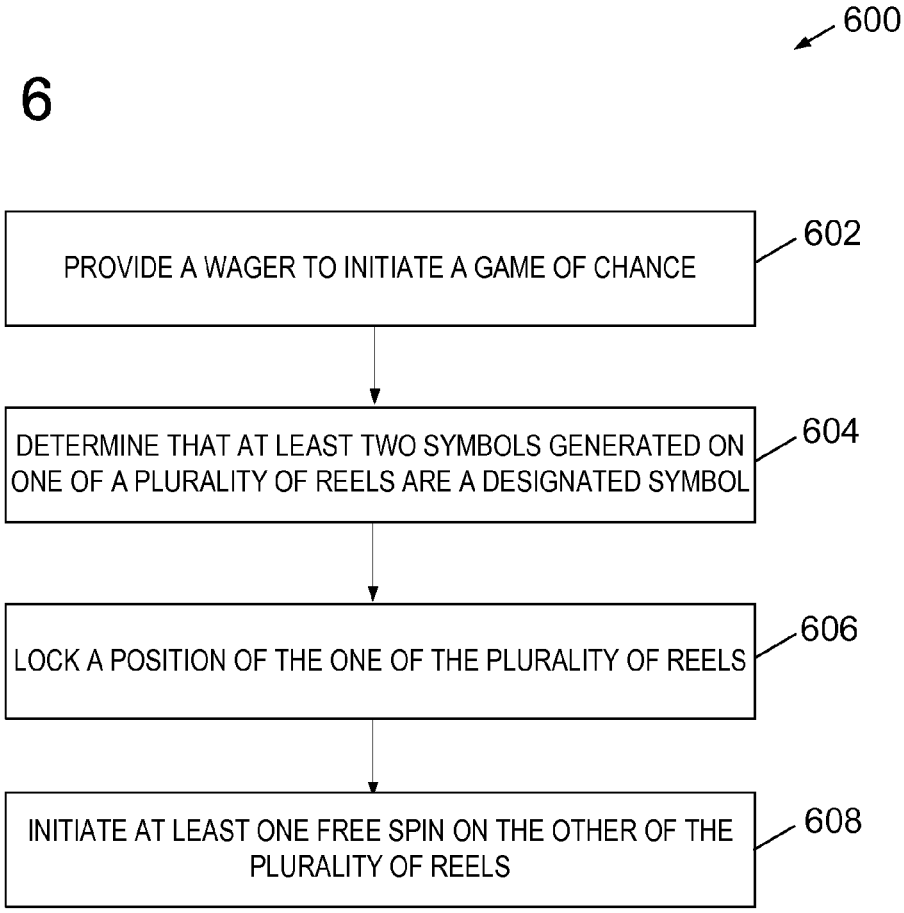
FIG. 6 is a flowchart that illustrates an exemplary method for providing a game of chance on the gaming machine shown in FIG. 1.

With reference now to FIG. 6, an exemplary method 600 for providing a game of chance on gaming machine 100 is provided. At 602, a player provides a wager to initiate a game of chance (e.g., a video slot game) on gaming machine 100. In one embodiment, a plurality of reels (e.g., three to five reels) associated with the game of chance are displayed on primary display device 118, and each of the plurality of reels include a defined plurality of positions to generate and display a symbol on primary display device 118. For example, if five reels are used in a video slot game and each reel is enabled to generate and display three symbols on primary display device 118, then primary display device 118 provides five columns of symbols, with three symbols in each column (as shown in FIGS. 4 and 5). In one embodiment, each reel includes a plurality of symbols (e.g., determinate symbols) that may be generated and displayed. Further, within the plurality of symbols that may be generated and displayed is a plurality of designated symbols (e.g., indeterminate symbols).

In one embodiment, a qualifying condition is met when two or more positions in a column generate and display a designated symbol (e.g., as shown in FIG. 4). For example, upon an initiation of the video slot game, each of the plurality of reels are spun and, at 604, it is determined that at least two symbols generated on one of the plurality of reels and displayed is a designated symbol (e.g., a "wild" symbol). In one embodiment, the qualifying condition may require each of the designated symbols to be generated and displayed in consecutive order. Further, the qualifying condition may require each position in an entire column to generate and display the designated symbol (e.g., as shown in FIG. 4). Based on the determination that at least two symbols generated on one of the plurality of reels and displayed are the designated symbol, at 606, a position of the one of the plurality of reels is locked, and at 608, the player is enabled to initiate at least one free "spin" on the other of the plurality of reels (e.g., the active reels). That is, the real that generates and displays two or more of the designated symbol is fixed, locked, or held stationary while the other reels are enabled to be spun again without requiring an additional wager.

In one embodiment, after a first free spin of the active reels, if none of the active reels generate and display the designated symbol, the game may be terminated, an award (if applicable) may be provided for the displayed symbols. However, in one embodiment, a predefined number of free spins may be provided such that if none of the active reels generate and display the designated symbol, the player may keep "spinning" the active reels up to the predefined number of free spins. Thus, if after the predefined number of free spines is used and none of the active reels have generated and displayed a designated symbol, the game is terminated, and if applicable, an award is provided based on the final displayed symbols. If, however, on any one of the predefined number of free spins a designated symbol is generated and displayed on one of the active reels, each position on each reel that generates and displays the designated symbol is locked and the player is enabled to "spin" the remaining positions of the active reels again (as shown in FIG. 5). In one embodiment, this process may continue until either it is determined that each reel has generated and displayed a designated symbol, or until it is determined that the predefined number of free "spins" is exhausted and none of the remaining active reels generated the designated symbol.

In one embodiment, each time a designated symbol is generated and displayed on any of the plurality of reels, a copy of the designated symbol is presented on secondary display device 142. As such, secondary display device 142 provides the player with the number of designated symbols accumulated during play of the video slot game. In one embodiment, a reward may be provided to the player once a predefined number of the designated symbol is accumulated on secondary display device 142. In another embodiment, a video slot bonus game may be initiated when a predefined number of the designated symbol is accumulated on secondary display device 142. Thus, the method of FIG. 6 may be repeated as the video slot bonus game.

Figure 7:
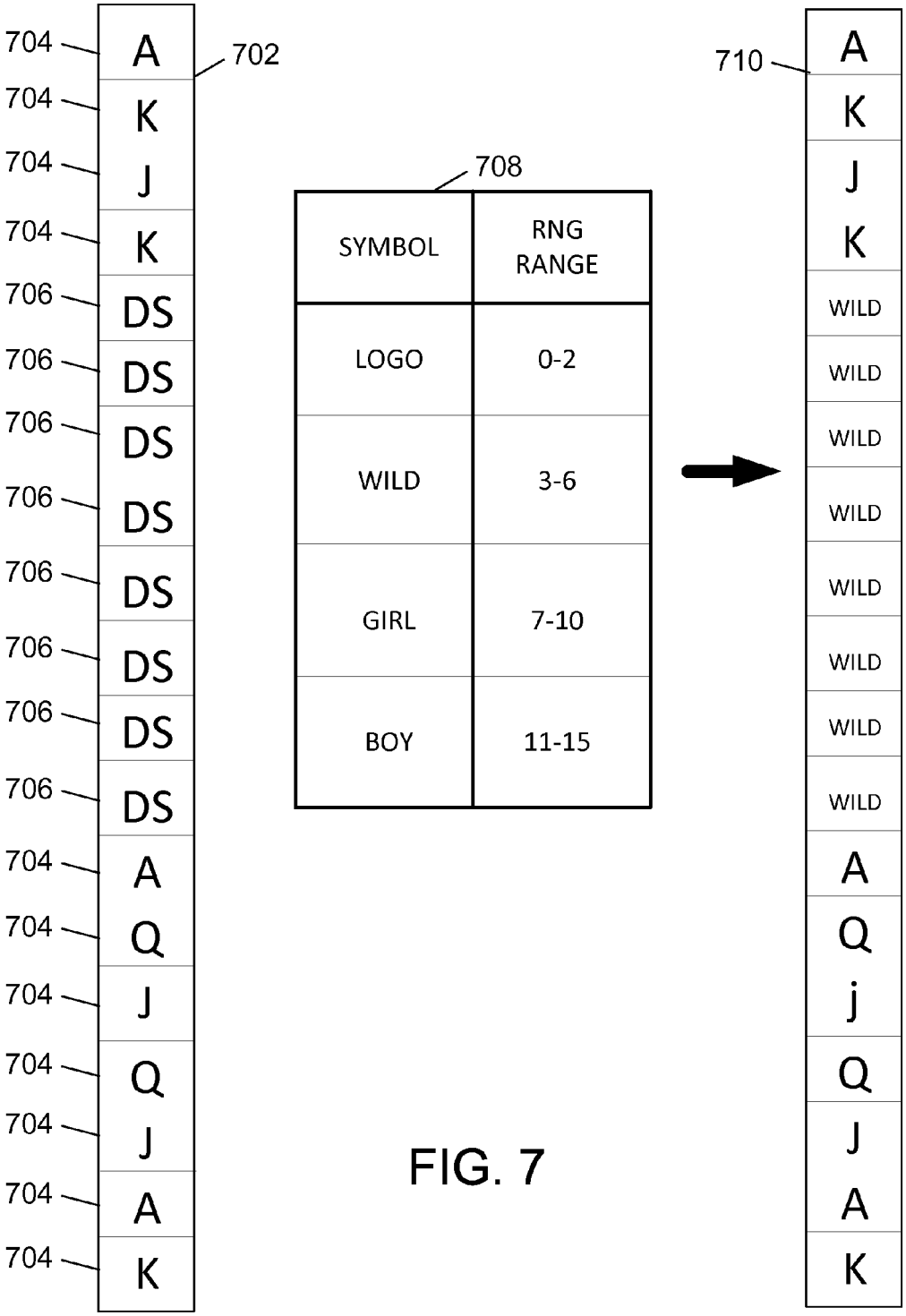
FIG. 7 is a block diagram illustrating a process for augmenting a reel in a game of chance provided on the gaming machine shown in FIG. 1.

With reference now to FIG. 7, a process for augmenting reels in a game of chance provided. For example, as shown in FIG. 7, reel 702 includes a plurality of defined symbol positions. A first set 704 of the plurality of defined symbol positions are configured to be populated with a plurality of determinate symbols. A second set 706 of the plurality of defined symbol positions are configured to be populated with an indeterminate symbol, such as a designated symbol. Upon initiation of the game of chance, first set 702 of the plurality of defined symbol positions on each of the plurality of reels are populated with determinate symbols (FIG. 7 showing an example of one reel 702 being populated with determinate symbols "A", "K", "J" . . . ), and a designated symbol is selected to populate second set 706 of the plurality of defined symbol positions on each of the plurality of reels. In one embodiment, a player is enabled to select a designated symbol. For example, the player may be enabled to select one of the determinate symbols in the game, a lucky number, or from a set of designated symbols provided to the player. In another embodiment, a random number generator (RNG) may use a weighted table 708 of designated symbols to determine which of the designated symbols to include in second set 706 of the plurality of defined symbol positions. Thus, after the RNG produces a particular number (e.g., "4"), that number is associated with a designated symbol in weighted table 708 and the associated designated symbol is included into second set 706 of the plurality of defined symbol positions. For example, augmented reel strip 710 includes designated symbol "wild" in each of the plurality of defined symbol positions in second set 706.

In one embodiment, not all of the reels in the video slot base game are augmented. For example, in a video slot base game that utilized five reels, each of the three middle reels may be augmented leaving the outside reels not augmented. In this example, only the three middle reels are used in the video slot bonus game. That is, non-augmented reels are not used in the video bonus game. However, once the reels selected to be augmented are augmented, the video slot game is initiated, each augmented real is "spun", and steps 604-608 described above with reference to FIG. 6 are executed.

In a further embodiment, second set 706 of the plurality of defined symbol positions may be populated with a plurality of designated symbols. In this example, after one of the plurality of reels (e.g., a first reel) generates and displays two or more of one of the designated symbols, that reel is locked. However, prior to "spinning" the remaining active reels, second set 706 of the plurality of defined symbol positions in each of the remaining active reels are changed to be populated with the designated symbol that was generated and displayed on the first reel. Thus, instead of second set 706 of the plurality of defined symbol positions on the remaining active reels still being populated with a plurality of designated symbols, they are now populated with the designated symbol that was generated and displayed on the first reel. This gives the player a better chance of matching the designated symbol. As such, second set 706 of the plurality of defined symbol positions can be populated with one or more designated symbols at a beginning of a game, and thereafter, be repopulated with a different designated symbol, or symbols during the game.

In embodiments, instead of dynamically generating reel strips by adding different symbols to a plurality of defined symbol positions on a reel strip at the beginning of each game, a similar effect can be created by generating predefined reel strips with the symbol stacks already "built-in" and storing these predefined reel strips in a reel strip database (e.g., within gaming server 302, memory area 306, or gaming machine 100). This enables, gaming software to fetch the predefined reel strips from the reel strip database, spin the reels, and display the game results. As such, picking a stack symbol, determining how many and where to put them in a reel strip, or to determine how many reels to do this to is not needed. As a result, game codes are simplified significantly, software bugs are reduced, and an increase in speed of game development cycles are achieved. In one embodiment, the rules for selecting predefined reel strips may be predefined and stored in a rules table to be looked up by the game software during execution.

In one embodiment, multiple reel strips with built-in symbol stacks are generated and stored in the reel strip database, and these reel strips are generated to be within the boundaries of desired paytables. As such, a subset of symbols are selected from a symbol set (e.g., all the face cards in a 52-card deck) to be the symbols available for a symbol stack. Additionally, parameters such as a stack height (e.g., a number of symbols), a weight associated with each symbol in the subset, a quantity (e.g., how many stacks in a reel strip), a location of the stack(s) in each reel strip, a number of reels participating, a location of the participating reels within a symbol matrix (e.g., consecutive reels, even reels, odd reels, etc.), and a total number of reel strips in the reel strip database are pre-designed to fit within the range of a paytable. In one embodiment, reel strip data stored in the reel strip database may be represented by an individual data array (e.g., one array for each reel), or as a monolithic array that comprises several mini data blocks (e.g., each block is one reel). The number of arrays and block size can be varied to create different game feel. For example, the reel strip database may have 512 arrays of 128 symbols in each array. Alternatively, it can be an array of 65,536 symbols that are subdivided into 512 blocks of 128 symbols each. In addition, each block or reel can be weighted differently to alter the payout frequency, or award sizes.

Figure 8:
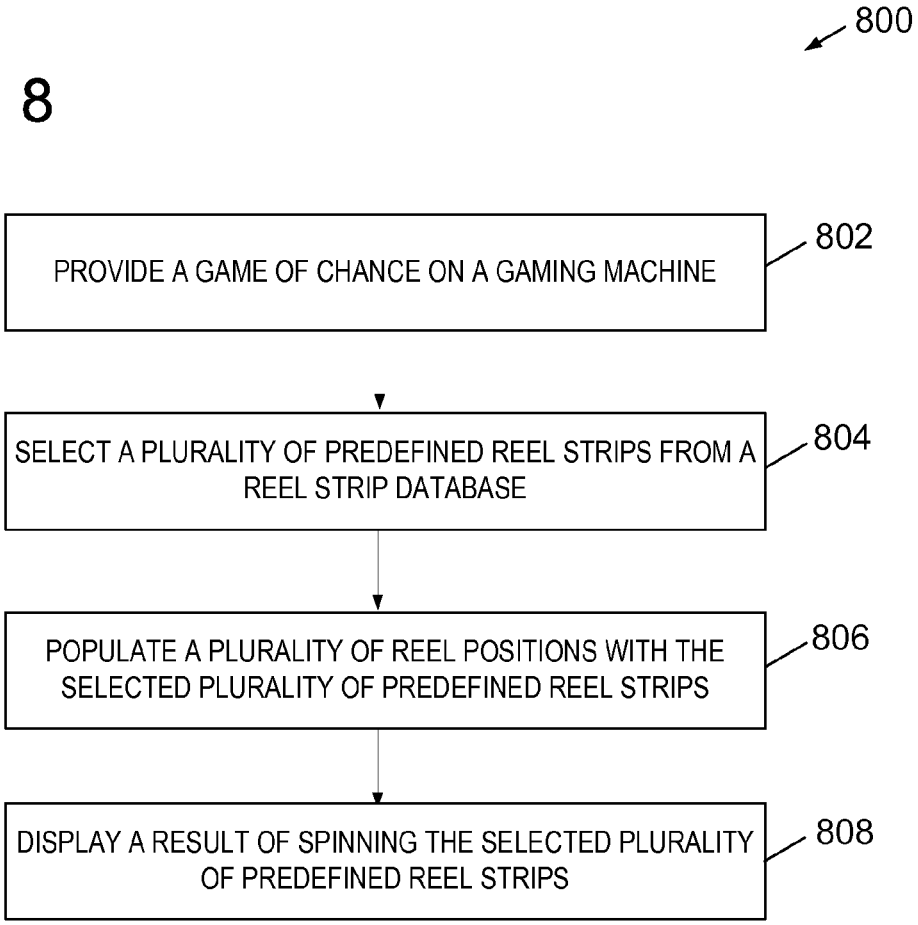
FIG. 8 is a flowchart that illustrates an exemplary method for providing a game of chance on the gaming machine shown in FIG. 1.

With reference now to FIG. 8, an exemplary method 800 for providing a game of chance using predefined reel strips on gaming machine 100 is provided. At 802, a game of chance on a gaming machine (e.g., gaming machine 100) is provided. At 804, a plurality of predefined reel strips are selected from the reel strip database. In one embodiment, reels with predefined symbol stacks can be selected either randomly or in a defined manner. Random selection of predefined reel strips from the reel strip database maybe accomplished using, for example, the RNG. However, predefined reel strips can also be selected as a function of which predefined reel strip was chosen previously. Thus, if "Reel 1" is randomly chosen from the reel strip database, depending on what symbol stacks are in Reel 1, the number of "Reel 2's" available for selection in the reel strip database may be a smaller subset than simply the remainder of all predefined reel strips in the reel strip database. For example, if Reel 1 has multiple stacks of Queen of Hearts implanted in Reel 1, Reel 2 may be chosen from a smaller subset of predefined reel strips that also have at least one Queen of Heart stack. A "Reel 3", "Reel 4", and "Reel 5" selection may also be under a similar rule (or selected at random in other embodiments). As a result, the Queen of Heart symbols can be built both vertically (e.g., the stack height) and horizontally across a display and a player can see the symbol build up in the matrix gradually, increasing the anticipation.

In one embodiment, rather than selecting each predefined reel strip separately, a plurality of reel strips may also be selected as a group. For example, choosing a certain type of reel strip for Reel 1 may lock in Reels 2, 3, 4, and 5. In another example, an RNG number generated may be mapped to a set of 5 predefined reel strips. The predefined reel strips may also be selected from pre-packaged reel sets after a defined number of games, after a defined number of minutes, after a defined amount of dollars of accumulated bet, after a losing streak of a defined number of games, or after every max wager is placed. Pre-packaged reel sets enable pre-designed special wins to occur at certain intervals, and give game designers another tool to control the player experience (e.g., skewing the data distribution to create a different volatility feel).

Certain predefined reel strips from the reel strip database can also be designed as bonusing reel strips (e.g., reel strips with wild stacks or a special symbol can trigger a bonus). Thus, the act of reel strip selection can be used as a triggering event for a feature game. In one embodiment, the bonus may be free spins, win multipliers, a bonus 6th reel, a play of a secondary game, an additional payout, and the like.

With reference back to FIG. 8, at 806, the plurality of reel positions are populated with the selected plurality of predefined reel strips, and at 808, a result of spinning the selected plurality of predefined reel strips is displayed to the player. As explained above with respect to FIG. 4, if a qualifying condition (e.g., a particular arrangement of one or more designated symbol) is met when the result of spinning the selected plurality of predefined reel strips is displayed to the player the predefined reel strip that achieved the qualifying condition is fixed/locked/held stationary and the player is enabled to execute a first free "spin" of the other predefined reels that are not locked. That is, the predefined reel strips that are not locked remain active while the predefined reel that achieved the qualifying condition is locked in place. In one embodiment, instead of using the same predefined reel strips from the original spin, after a qualifying condition has been met, one or more of the remaining predefined reel strips (e.g., the predefined reel strips that did not achieve the qualifying condition) are replaced with other pre-defined reel strips from the reel strip database prior to the free spin being executed. In another embodiment, the existing predefined reel strips may be re-ordered instead of (or in addition to) being replaced.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein.

Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine configured to operate a wagering game, the gaming machine comprising:

a credit input mechanism comprising at least one of a coin acceptor, a bill validator, and a ticket reader configured to receive a physical item of monetary value to establish a credit balance;

a memory device configured to store a reel strip database of predefined reel strips;

a display device configured to display a plurality of reel positions, each of the plurality of reel positions configured to present a symbol thereon; and a processor programmed to:

receive a wager amount placed for play of a single play of the wagering game, the wager amount decreasing the credit balance;

during the single play of the wagering game, select a first reel strip from the reel strip database, the first reel strip comprising a first set of predefined symbols;

during the single play of the wagering game, select a second reel strip from the reel strip database;

display, at the plurality of reel positions, a first randomly determined outcome for the single play of the game by spinning the first reel strip and the second reel strip;

in response to the first randomly determined outcome, select, during the single play of the game, a replacement reel strip from the reel strip database, wherein the replacement reel strip is selected based upon the first set of predefined symbols;

replace the second reel strip with the replacement reel strip;

display, at the plurality of reel positions, a second randomly determined outcome for the single play of the game by spinning only the replacement reel strip; and award at least one prize based upon at least one of i) the first randomly determined outcome and ii) the second randomly determined outcome, the at least one prize increasing the credit balance.

2. A gaming machine in accordance with claim 1, wherein the first reel strip is randomly selected.

3. A gaming machine in accordance with claim 1, wherein the processor is further programmed to select a third reel strip from the reel strip database, the third predefined reel strip being selected based on one or more of the following: the first set of predefined symbols in the first reel strip, and a second set of predefined symbols in the second reel strip.

4. A gaming machine in accordance with claim 1, wherein the first set of predefined symbols in the first predefined reel strip comprises at least one designated symbol, and wherein the second reel strip is selected based on the at least one designated symbol.

5. A gaming machine in accordance with claim 1, wherein the processor is further configured to:

determine that at least one symbol displayed on the first reel strip is a designated symbol;

based on the determining, locking a position of the the first reel strip; and spinning the second reel strip after locking the position of the first reel strip.

6. A method for playing a game of chance on a gaming machine comprising a display and a plurality of reel positions associated with the game of chance, the plurality of reel positions defining a set of reel strips, the method comprising:

receiving a credit input through a credit input mechanism including at least one of a coin acceptor, a bill validator, and a ticket reader to establish a credit balance;

receiving a wager amount placed for play of a single play of the game of chance, the wager amount decreasing the credit balance;

during the single play of the wagering game, select a first reel strip from the reel strip database, the first reel strip comprising a first set of predefined symbols;

during the single play of the wagering game, selecting a second reel strip from the reel strip database;

displaying, at the plurality of reel positions, a first randomly determined outcome for the single play of the game by spinning the first reel strip and the second reel strip;

in response to the first randomly determined outcome, selecting, during the single play of the game, a replacement reel strip from the reel strip database, wherein the replacement reel strip is selected based upon the first set of predefined symbols;

replacing the second reel strip with the replacement reel strip;

displaying, at the plurality of reel positions, a second randomly determined outcome for the single play of the game by spinning only the replacement reel strip; and awarding at least one prize based upon at least one of i) the first randomly determined outcome and ii) the second randomly determined outcome, the at least one prize increasing the credit balance.

7. A method in accordance with claim 6, wherein the first reel strip and the second reel strip are selected as a predefined group.

8. A method in accordance with claim 6, further comprising selecting a third reel strip, the third reel strip being selected based on one or more of the following: the first set of predefined symbols in the first reel strip, and a second set of predefined symbols in the second reel strip.

9. A method in accordance with claim 6, wherein the first set of predefined symbols in the first reel strip comprises at least one designated symbol, and wherein the second reel strip is selected based on the the at least one designated symbol.

10. A method in accordance with claim 6, further comprising:

determining that at least one symbol displayed on the first reel strip is a designated symbol;

based on the determining, locking a position of the first reel strip; and spinning the second reel strip after locking the position of the first reel strip.

11. A gaming system comprising:

a reel strip database comprising a plurality of predefined reel strips; and a gaming machine configured to operate a wagering game, the gaming machine comprising:

a credit input mechanism comprising at least one of a coin acceptor, a bill validator, and a ticket reader configured to receive a physical item of monetary value to establish a credit balance;

a display device configured to display a plurality of reel positions, each of the plurality of reel positions configured to present a symbol thereon; and a processor programmed to:

receive a wager amount placed for play of a single play of the wagering game, the wager amount decreasing the credit balance;

during the single play of the wagering game, select a first reel strip from the reel strip database, the first reel strip comprising a first set of predefined symbols;

during the single play of the wagering game, select a second reel strip from the reel strip database;

display, at the plurality of reel positions, a first randomly determined outcome for the single play of the game by spinning the first reel strip and the second reel strip;

in response to the first randomly determined outcome, select, during the single play of the game, a replacement reel strip from the reel strip database, wherein the replacement reel strip is selected based upon the first set of predefined symbols;

replace the second reel strip with the replacement reel strip;

display, at the plurality of reel positions, a second randomly determined outcome for the single play of the game by spinning only the replacement reel strip; and award at least one prize based upon at least one of i) the first randomly determined outcome and ii) the second randomly determined outcome, the at least one prize increasing the credit balance.

12. A gaming system in accordance with claim 11, wherein the plurality of predefined reel strips within the reel strip database are generated and stored within the reel strip database to accommodate desired paytables.

13. A gaming system in accordance with claim 11, wherein processor is further programmed to select a third reel strip from the reel strip database, the third reel strip being selected based on one or more of the following: the first set of predefined symbols in the first reel strip, and a second set of predefined symbols in the second reel strip.

14. A gaming system in accordance with claim 13, wherein the processor is further programmed to select a fourth reel strip from the reel strip database, the fourth reel strip being selected based on one or more of the following: the first set of predefined symbols in the first reel strip, the second set of predefined symbols in the second reel strip, and a third set of predefined symbols in the third reel strip.

15. A gaming system in accordance with claim 11, wherein the processor is further programmed to select a fifth reel strip, the fifth reel strip being selected based on one or more of the following: the first set of predefined symbols in the first reel strip, the second set of predefined symbols in the second reel strip, the third set of predefined symbols in the third reel strip, and a fourth set of predefined symbols in the fourth reel strip.

16. A gaming system in accordance with claim 11, wherein the processor is further configured to:

determine that at least one symbol displayed on the first reel strip is a designated symbol;

based on the determining, locking a position of the first reel strip; and spinning the second reel strip after locking the position of the first reel strip.

* * * * *